US011120780B2

(12) United States Patent
Dron

(10) Patent No.: US 11,120,780 B2
(45) Date of Patent: Sep. 14, 2021

(54) EMULATION OF AT LEAST ONE SOUND OF A DRUM-TYPE PERCUSSION INSTRUMENT

(71) Applicant: REDISON, Lens (FR)

(72) Inventor: Jerome Dron, Illies (FR)

(73) Assignee: REDISON, Lens (FR)

( * ) Notice: Subject to any disclaimer, the term of this patent is extended or adjusted under 35 U.S.C. 154(b) by 235 days.

(21) Appl. No.: 16/470,444

(22) PCT Filed: Jan. 8, 2018

(86) PCT No.: PCT/FR2018/050034
§ 371 (c)(1),
(2) Date: Jun. 17, 2019

(87) PCT Pub. No.: WO2018/130768
PCT Pub. Date: Jul. 19, 2018

(65) Prior Publication Data

US 2020/0111461 A1 Apr. 9, 2020

(30) Foreign Application Priority Data

Jan. 11, 2017 (FR) ..... 1750229

(51) Int. Cl.
*G10H 1/00* (2006.01)
*G10H 3/14* (2006.01)
(Continued)

(52) U.S. Cl.
CPC ..... *G10H 1/0008* (2013.01); *G10D 13/11* (2020.02); *G10H 1/0083* (2013.01); *G10H 3/146* (2013.01);
(Continued)

(58) Field of Classification Search
CPC .... G10H 1/0008; G10H 1/0083; G10H 3/146; G10H 5/007; G10H 2220/185;
(Continued)

(56) References Cited

U.S. PATENT DOCUMENTS 4,995,294 A * 2/1991 Kashio ..... G10H 1/34 200/61.48
5,399,801 A * 3/1995 Hasebe ..... G10H 1/42 84/622
(Continued)

FOREIGN PATENT DOCUMENTS

JP 2007256736 A 10/2007
JP 2006162904 A 3/2009
(Continued)

OTHER PUBLICATIONS

Anonymous, "Freedrum: The Drumkit That Fits in Your Pocket by Freedrum", Kickstarter, http://web.archive.org/web/20161126051330/https://www.kickstarter.com/projects/freedrum/freedrum-the-drumkit-that-fits-inyour-pocket, Feb. 13, 2018, pp. 1-23.

*Primary Examiner* — Jeffrey Donels
*Assistant Examiner* — Christina M Schreiber
(74) *Attorney, Agent, or Firm* — Tutunjian & Bitetto, P.C.

(57) ABSTRACT

The present invention relates to a removable electronic device for emulating at least one sound of a drum-type percussion instrument, said device being intended to instrumentalise a striking element. A defining means defines a striking area on a tangible support. An allocating means allocates a drum element associated with a predetermined sound to the striking area, in a database. At least one sensor generates a stroke signal having at least one piece of stroke information on a stroke of a user with the striking element in the striking area. A computer processing means implements a processing algorithm configured to process the stroke signal to spatially locate said stroke in order to detect the area struck and to determine the drum element corresponding to this area struck. A generating means is configured to generate a sound signal comprising information on
(Continued)

Figure 1:
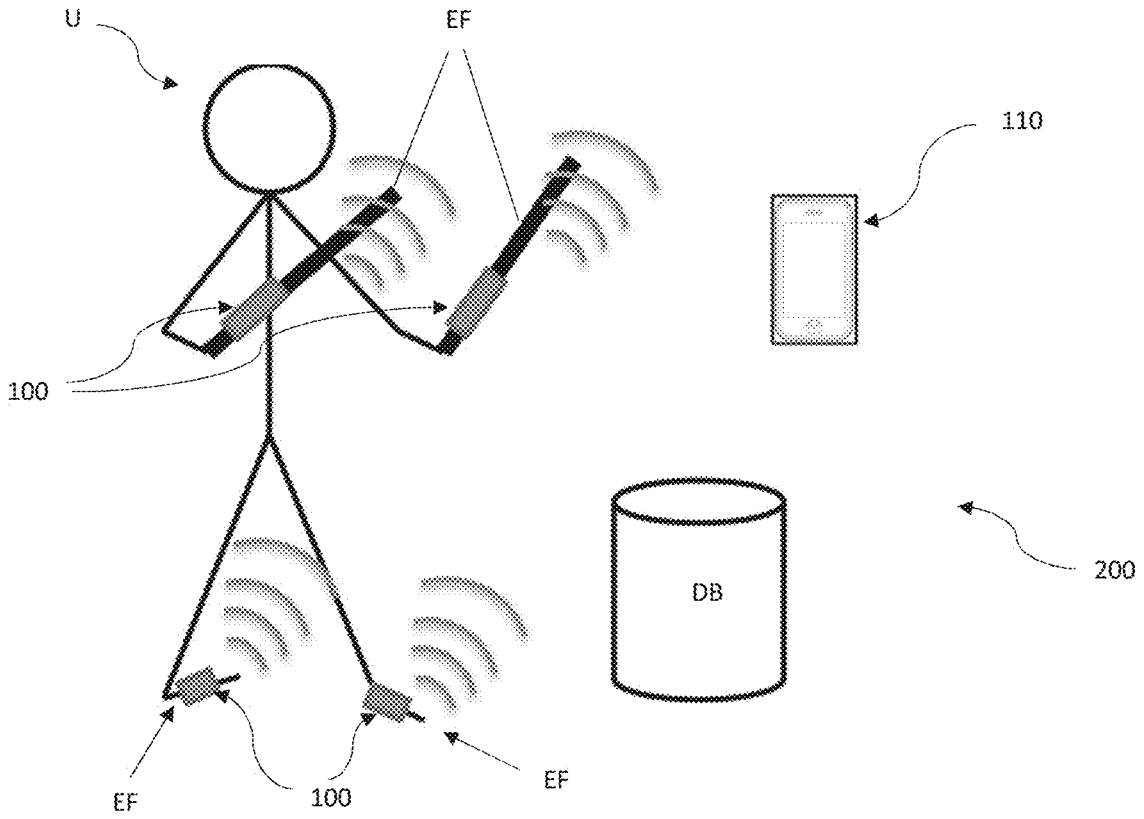

the sound virtually generated by said stroke of the striking element in said area struck.

7 Claims, 5 Drawing Sheets

(51) Int. Cl.
*G10H 5/00* (2006.01)
*G10D 13/11* (2020.01)

(52) U.S. Cl.
CPC ..... *G10H 5/007* (2013.01); *G10H 2220/185* (2013.01); *G10H 2220/391* (2013.01); *G10H 2220/395* (2013.01); *G10H 2220/401* (2013.01); *G10H 2230/275* (2013.01)

(58) Field of Classification Search
CPC ..... G10H 2220/391; G10H 2220/395; G10H 2220/401; G10H 2230/275; G10D 13/11
USPC ..... 84/634
See application file for complete search history.

(56) References Cited

U.S. PATENT DOCUMENTS 8,003,873 B2 * 8/2011 Rasker ..... G10H 3/146 84/610
10,102,835 B1 * 10/2018 Shah ..... G06F 3/017
2004/0200338 A1 * 10/2004 Pangrle ..... G10H 3/06 84/724
2010/0261513 A1 * 10/2010 Izen ..... G10H 3/146 463/7
2011/0030533 A1 * 2/2011 Piccionelli ..... G10H 1/32 84/422.4
2011/0132181 A1 * 6/2011 Kockovic ..... G10H 1/34 84/723
2011/0239847 A1 * 10/2011 Small ..... G10H 1/36 84/723
2013/0152768 A1 * 6/2013 Rapp ..... G10D 13/12 84/634
2013/0239785 A1 * 9/2013 Tabata ..... G10H 1/0008 84/609
2013/0262024 A1 * 10/2013 Sakurai ..... G10H 1/0008 702/150
2015/0356957 A1 * 12/2015 Piccionelli ..... G10D 13/12 84/422.4
2016/0203806 A1 * 7/2016 Hardi ..... G10D 13/12 84/600
2016/0322040 A1 * 11/2016 Hardi ..... G10D 13/26
2017/0103742 A1 * 4/2017 Piccionelli ..... G10H 1/0083
2017/0329515 A1 * 11/2017 Clement ..... G06F 3/011
2020/0111461 A1 * 4/2020 Dron ..... G10H 5/007

FOREIGN PATENT DOCUMENTS

WO 2011097371 A1 8/2011
WO WO-2011097371 A * 8/2011 ..... G10H 1/0083

* cited by examiner

EMULATION OF AT LEAST ONE SOUND OF A DRUM-TYPE PERCUSSION INSTRUMENT

TECHNICAL FIELD AND PRIOR ART

The present invention relates to the field of musical instruments, and more particularly to the field of percussion instruments.

One of the purposes of the present invention is to provide users, musicians and music lovers with an emulation method and computer-based system for emulating, on a communication terminal of the smartphone type, for example, at least one sound of a percussion instrument using a plurality of electronic sensors embedded in striking elements, for example of the drumstick or drum pedal type.

The present invention thus has numerous advantageous applications in the field of drums. It goes without saying that other advantageous applications can also be considered for other percussion instruments.

Musicians (in this case drummers) currently benefit from several solutions for playing the drums.

These solutions mainly include the following families so-called acoustic drum kits;

so-called electronic drum kits; and so-called virtual drum kits also known as "air drum kits".

Acoustic drum kits have a conventional configuration and are in particular composed of one or more toms and/or of one or more cymbals.

Conventionally, by striking each of these elements using drumsticks and/or pedals, the musician generates a sound associated with each tom or with each cymbal.

These acoustic drum kits have numerous advantages, in particular for the musician, who experiences a real playing pleasure and comfort.

Musicians also appreciate acoustic drum kits because they alone provide a sound that can be qualified as "natural".

It should also be noted that acoustic drum kits do not require any computer technology or power source for operation.

However, acoustic drum kits have substantial drawbacks such as, for example, the fact that they are very bulky and heavy to transport.

These drum kits are thus mainly intended for so-called sedentary use.

They are also noisy under normal use.

It is thus difficult to play the drums for example in an apartment, both because of the neighbours and the overall dimensions of the drum kit.

For the same reasons, it is understood that playing an acoustic drum kit in the street or outside of the musician's home is also difficult.

Electronic drum kits are also composed of one or more toms and of one or more cymbals. In a characteristic manner, each of the component elements of the electronic drum kit is instrumentalised by one or more electronic sensors.

In general, the sensors used are piezoelectric sensors.

By striking each of the elements of the drum kit using drumsticks and/or pedals, the different sensors generate an electronic signal specific to each of these elements.

The signals generated by the system are then sent to a sound control and generation module that is directly connected to the drum kit.

The signals used are MIDI-type signals.

Numerous electronic drum kit models further allow for the transmission of the MIDI signals to third-party devices.

The playing comfort of these electronic drum kits is highly appreciated.

By incorporating electronics, the drum kits make it possible to modulate the audio volume; they further make it possible to change the resonance, record a melody played on an electronic medium or even interact with the different software.

However, these electronic drum kits remain just as bulky and heavy to transport.

It should also be noted that these drum kits require a power supply and sound amplification or listening equipment in order to listen to the beat induced by the strokes on the elements of the drum kit.

Virtual or "air drum kits" represent a new generation of drum kits that overcome the aforementioned issues regarding bulkiness.

These drum kits are composed of drumsticks, pedals and electronic sensors attached to these striking elements.

In order to play the drums, the musician is equipped with these striking elements and imitates playing the drums by striking the air in invisible areas.

The movements of the musician's drumsticks are thus translated by computer technology into sounds using third-party devices (computer or smartphone) in real time.

One of the main drawbacks of "air drum kits" is the fact that the musician is striking the air and cannot benefit, when playing, of the rebound resulting from the drumstick bouncing off of an element of the drum kit.

This is not a natural way of playing, but an imitation of the movements of a drummer, which makes it relatively unattractive to real musicians, who need this rebound in order to obtain the pleasure and comfort of playing that is procured by acoustic and electronic drum kits.

Thus, the applicant advances that virtual drum kits such as those proposed today are not able to convince drummers since they do not propose technology that allows them to play the drums with minimal equipment while preserving the playing pleasure and comfort.

SUMMARY AND PURPOSE OF THE PRESENT INVENTION

The present invention aims to improve on the situation described hereinabove.

One of the purposes of the present invention is to overcome the different aforementioned drawbacks by proposing a computer-based system of the virtual drum kit type, additionally procuring, relative to existing solutions, the pleasure and comfort sought after by musicians in order to preserve the playing sensations.

According to a first aspect, the present invention relates to a method for emulating one or more sounds of a drum-type percussion instrument using one or more striking elements, each of which is instrumentalised by an electronic device.

Advantageously, the electronic device is attached in a removable manner to the striking element.

The electronic device is thus removable and comprises assembly means designed to engage with complementary assembly means of said striking element so as to allow for the rigid assembly of said device with said striking element. Preferably, the device is positioned on the middle portion of the striking element and does not hinder the strokes of the musician.

According to the present invention, the electronic device comprises one or more sensors designed to provide at least one piece of information, referred to as stroke information, on a stroke of a user with said striking element.

This information contains, for example, information on the movement of the stroke (for example the velocity, location of the striking element, intensity of the stroke, etc.).

Advantageously, the method according to the present invention is implemented by computer-based means and comprises an initialisation phase and a playing phase.

More particularly, the initialisation phase comprises the following steps of:

defining, on at least one tangible support, one or more striking areas; and allocating, in a database, each striking area previously defined with a drum kit element associated with a predetermined sound.

The term "tangible support" is understood in the entire description hereafter to mean a support having a physical and palpable materiality, such a support procuring the rebound expected by drummers for their playing comfort and pleasure.

This can, for example, be a table, a wall or any other type of equivalent support providing mechanical resistance allowing for a rebound to be felt in the striking element. It should be noted herein that this can also be a tom or a cymbal.

Advantageously, the playing phase comprises the following steps of:

after a stroke by the user with the striking element, acquiring at least one stroke signal generated by the one or more sensors and comprising at least one piece of stroke information;

processing said at least one stroke signal in such a way as to spatially locate the stroke in order to detect the striking area and to determine, by comparing with the database, the drum element corresponding to this striking area having been struck;

generating a sound signal comprising information on the sound virtually generated by the stroke of the striking element in the area struck.

Thanks to this succession of technical steps, characteristic of the present invention, the musicians procure an emulation of a sound of a percussion instrument without requiring bulky equipment (toms, cymbals, etc.).

The present invention, thanks to the generation of one or more sound signals, allows musicians to play with minimal equipment and to record their beat without having to position microphones and/or without having to use an electronic drum kit.

The definition of striking areas on tangible supports procures the playing comfort and pleasure expected by musicians, and differentiates the present invention from the current systems proposed for "air drum kits".

Once the striking areas have been defined and the musician has built his/her database by associating each area with a virtual drum kit element, the musician can play the drums with his/her striking elements (in this case drumsticks and pedals for example). This initialisation phase allows the musician to truly customise the drum kit and playing style.

In one advantageous embodiment, the sensor comprises an accelerometer-type sensor. In this embodiment, during the acquisition step, the sensor provides information on the velocity of the striking element. Still with reference to this embodiment, the velocity of the striking element is taken into consideration in order to calculate, during the generation step, the intensity of the sound virtually generated by the stroke of the element in the area.

Other parameters provided by the sensor can also be taken into consideration to calculate this intensity.

The additional detection of impacts on the support by the addition of a piezoelectric sensor on the striking element can also be provided.

In another embodiment, which can be taken in combination with the preceding embodiment, the sensor comprises a gyroscope-type sensor.

In this other embodiment, during the acquisition step, the sensor provides information on the spatial coordinates of the striking element at the time of the impact of the striking element in the striking area. Still with reference to this embodiment, the spatial coordinates of the striking element are taken into consideration during the processing step in order to locate the stroke in space.

The integration of such a sensor provides reliable information on the impact of the stroke on the support in order to accurately determine the location of the impact.

The use of such a gyroscope further allows the striking areas to be defined during the initialisation phase.

According to one alternative embodiment, each striking area is defined by the user by means of a gyroscope-type sensor; during the definition step, this provides the spatial coordinates associated with the centre of the striking area and the periphery thereof.

Advantageously, the method according to the present invention further comprises, during the playing phase, a first step of transmitting the sound signal to a communication terminal.

This sound signal transmission to the terminal is carried out by wireless communication means and allows the sound virtually generated by the stroke of the element in the striking area to be audibly reproduced on the terminal.

It is understood herein that the sound signal generated by the electronic device can be understood by the terminal, which comprises software means designed for reading this signal and the information contained therein.

It should also be noted that having such a signal transmitted to the terminal significantly eases access to social networks and computer-based music sharing platforms.

Advantageously, the method according to the present invention further comprises a second step of transmitting the stroke signal to the communication terminal.

Similarly, this transmission of the stroke signal to the terminal is carried out by wireless communication means and allows, for example, the movements of each striking element to be visually displayed on the terminal.

It is understood herein that the stroke signal generated by the one or more sensors can be understood and directly exploited by the terminal, which comprises software means designed for reading said one or more signals and the information contained therein.

In addition to the movements of the striking elements, the terminal can also allow the tempo of the drummer to be monitored, or the striking precision of the drummer to be analysed.

The terminal furthermore allows the beat of the drummer to be analysed in real time within the scope of using functionalities for learning to play the drums (partitions, lessons, etc.).

Musicians using the system can thus practice and see whether their beat corresponds to the partition that they are playing in real time (visual and audio alerts linked to the tempo and elements that must be struck from the software).

Correlatively, according to a second aspect, the present invention relates to a computer program that comprises instructions suitable for executing the steps of the method as described hereinabove, in particular when said computer program is executed by at least one processor.

Such a computer program can use any programming language and be in the form of a source code, object code, or intermediate code between a source code and an object code, such as a partially compiled form, or in any other desired form.

Similarly, according to a third aspect, the present invention relates to a computer-readable recording medium on which a computer program is stored, said computer program comprising instructions for executing the steps of the method as described hereinabove.

On the one hand, the recording medium can be any entity or device capable of storing the program. For example, the medium can comprise a storage means, such as a ROM, for example a CD-ROM or a microelectronic circuit-type ROM, or even a magnetic recording means or a hard drive.

On the other hand, this recording medium can also be a transmittable medium such as an electric or optical signal, such a signal capable of being carried via an electric or optical cable, by conventional or wireless radio, or by self-steered laser beam or any other means. The computer program according to the invention can in particular be downloaded from an Internet-type network.

Alternatively, the recording medium can be an integrated circuit into which the computer program is incorporated, the integrated circuit being suitable for executing or for use in the execution of the method in question.

According to a fourth aspect, the present invention relates to a removable electronic device for emulating at least one sound of a drum-type percussion instrument.

According to the invention, the device comprises computer-based means designed to implement the steps of the method described hereinabove.

More particularly, the electronic device according to the present invention is intended to instrumentalise a striking element and in particular comprises:

- defining means designed to define at least one striking area on at least one tangible support;
- allocating means designed to allocate a drum element associated with a predetermined sound to said at least one striking area, in a database;
- at least one sensor designed to generate a stroke signal comprising at least one piece of so-called stroke information on a stroke of a user with said at least one striking element in said at least one striking area;
- computer processing means implementing a processing algorithm designed to process said stroke signal in such a way as to spatially locate said stroke in order to detect said striking area and to determine, by comparing with said database, the drum element corresponding to said area struck;
- generating means designed to generate a sound signal comprising information on the sound virtually generated by said stroke of the striking element in said area.

Preferably, the device further comprises assembly means designed to allow the device to be rigidly assembled with the striking element.

According to a fifth aspect, the present invention relates to a computer-based system for emulating at least one sound of a drum-type percussion instrument, said system comprising:

- a removable electronic device as described hereinabove, and
- a communication terminal capable of communicating with the electronic device by wireless communication means.

According to the invention, the communication terminal comprises software means designed to receive and process the sound signal generated by the device in order to audibly reproduce the sound virtually generated by the stroke of the striking element in the striking area.

Thus, the purpose of the present invention, by way of the different functional and structural aspects thereof described hereinabove, allows musicians and more particularly drummers to play with minimal equipment, while preserving their playing comfort and pleasure.

BRIEF DESCRIPTION OF THE ACCOMPANYING FIGURES

Figure 2:
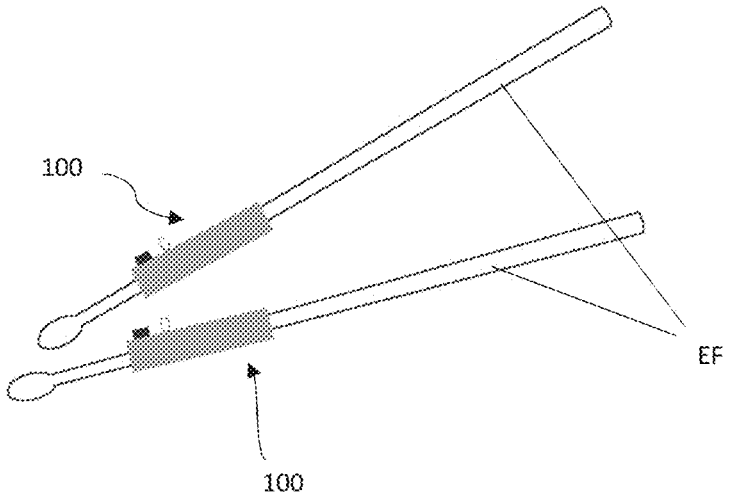
Figure 3:
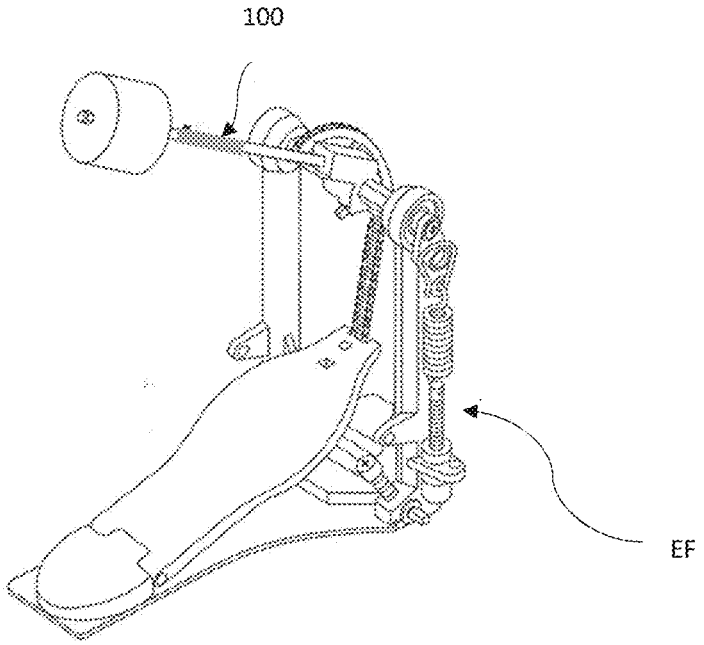
Figure 4:
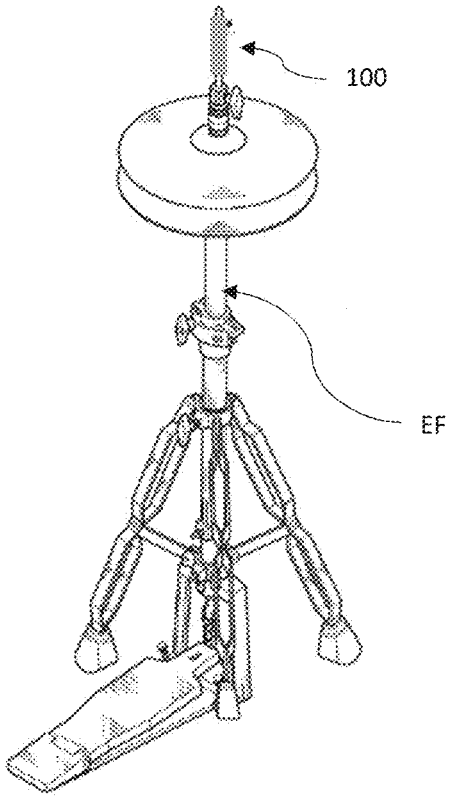
Figure 5:
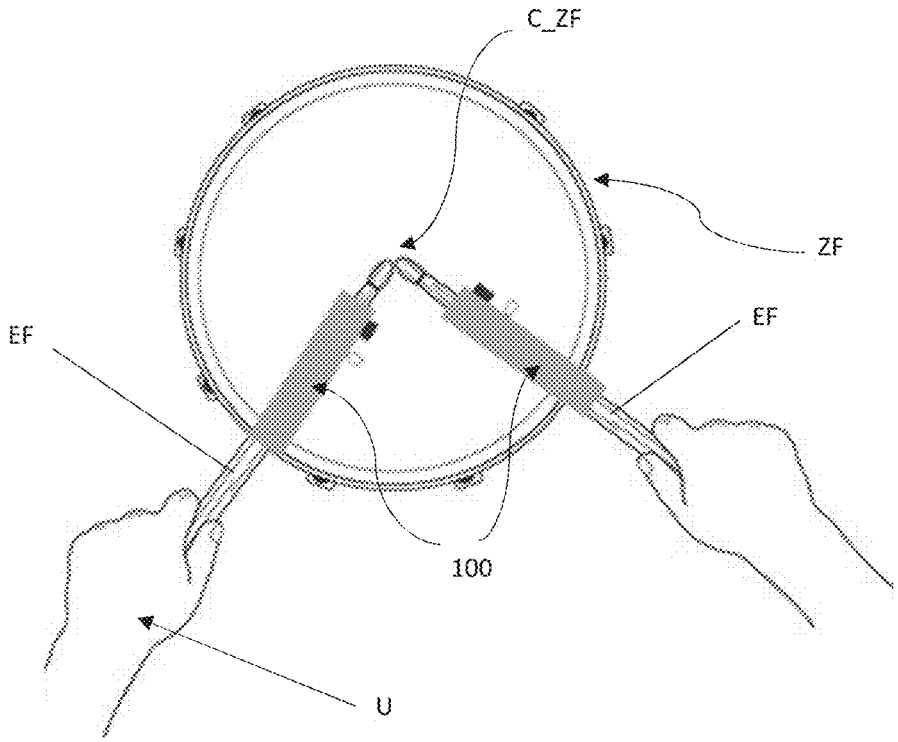
Figure 6:
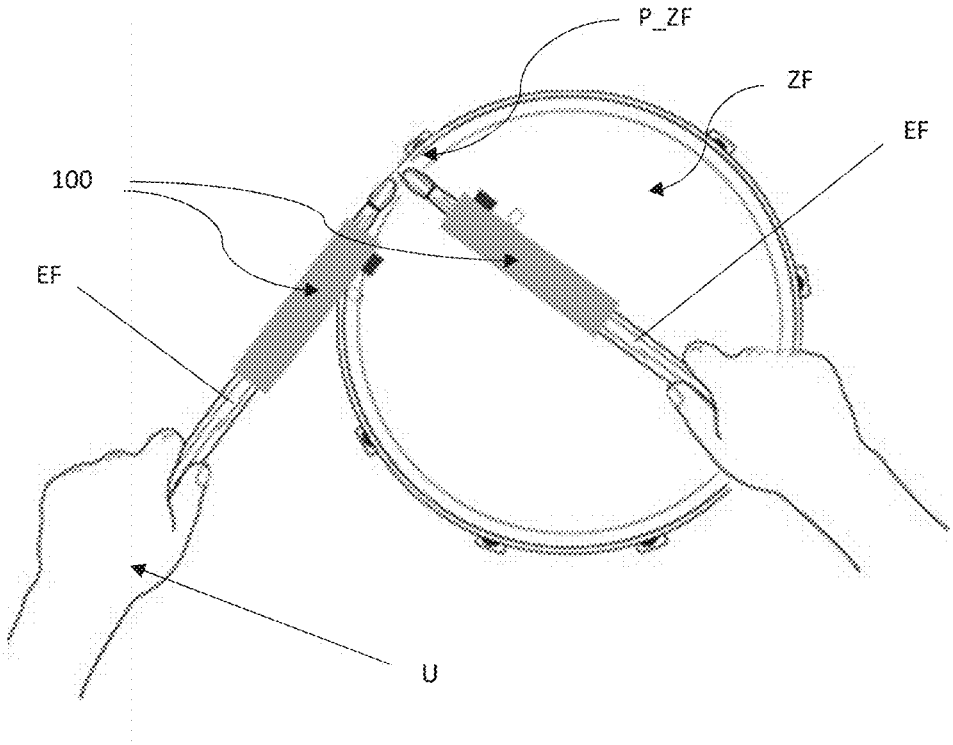
Figure 7:
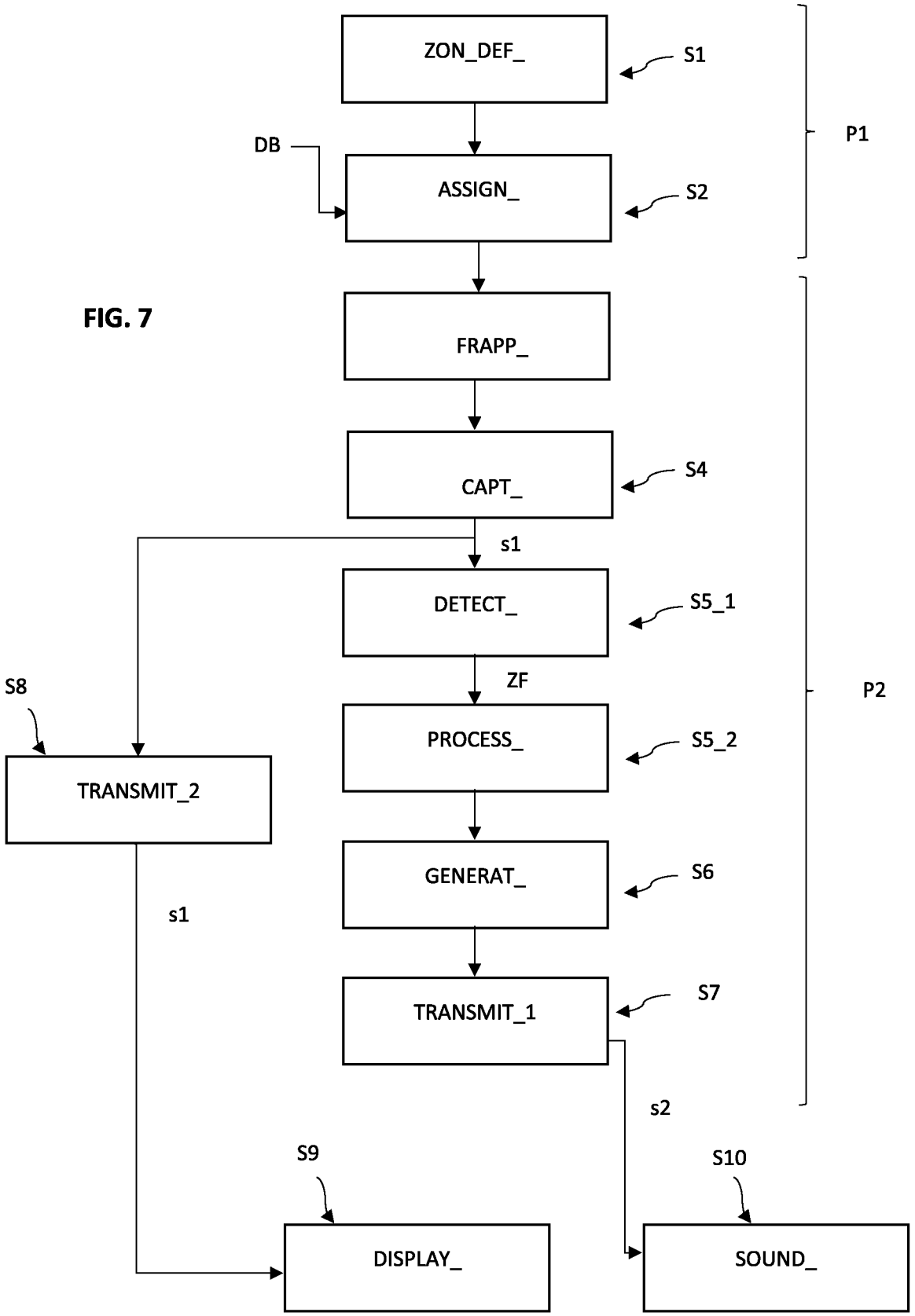
Figure 8:
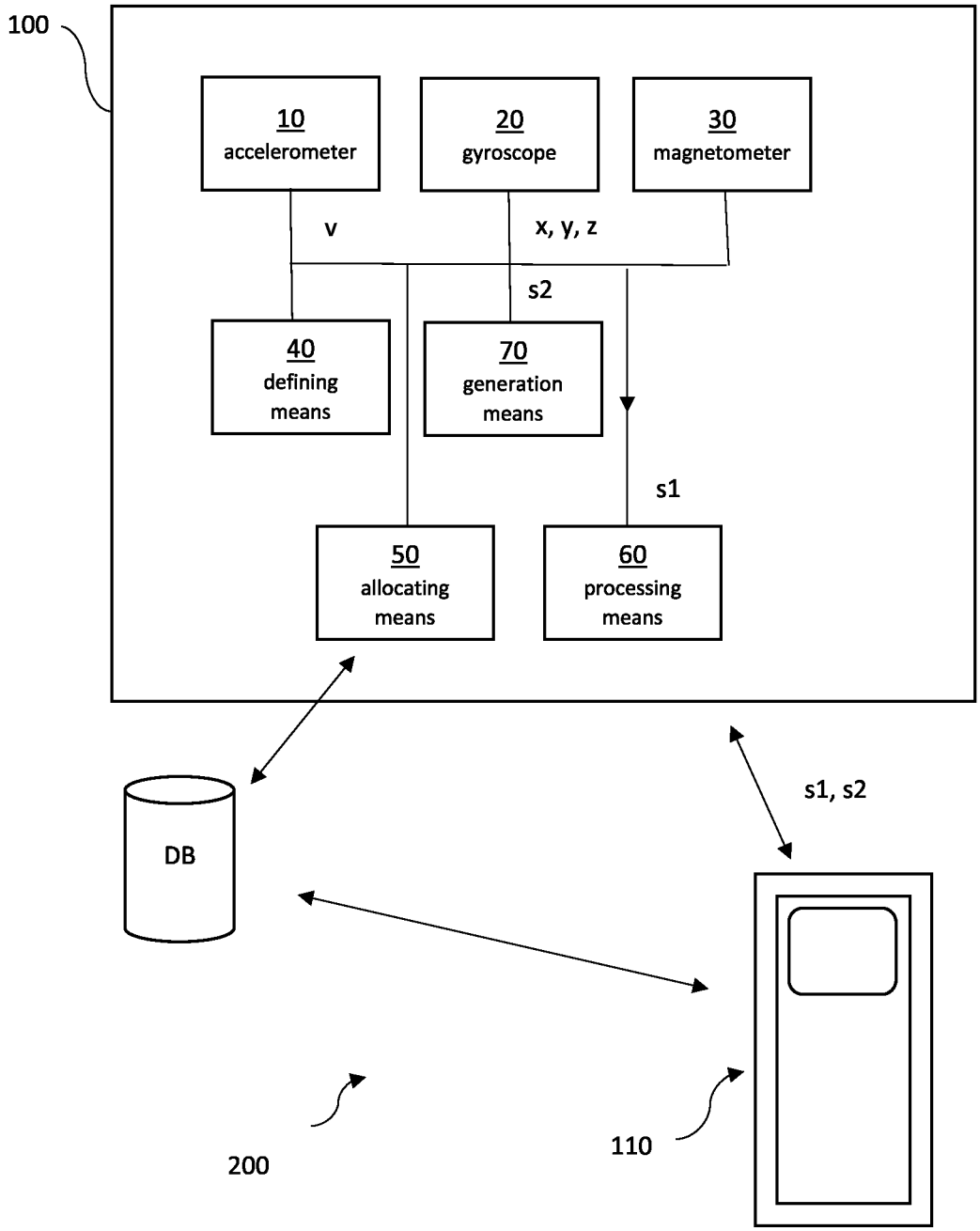

Other characteristics and advantages of the present invention will be better understood upon reading the description hereinbelow with reference to the accompanying FIGS. 1 to 8, which illustrate one example embodiment devoid of any limiting features, wherein:

FIG. 1 diagrammatically shows a user playing with striking elements instrumentalised by a plurality of electronic devices according to one example embodiment of the present invention;

FIGS. 2, 3 and 4 each diagrammatically show the instrumentalisation of a striking element by an electronic device according to the invention;

FIGS. 5 and 6 diagrammatically show the different steps of defining striking areas according to one example embodiment of the present invention;

FIG. 7 shows a flowchart illustrating the different steps of the method according to one example embodiment of the present invention;

FIG. 8 diagrammatically shows a computer-based system for emulating a sound of a percussion instrument according to the invention.

DETAILED DESCRIPTION OF ONE ADVANTAGEOUS EXAMPLE EMBODIMENT

A method for emulating a sound of a percussion instrument in addition to the system associated therewith will be described hereafter with reference to FIGS. 1 to 8.

As a reminder, one of the purposes of the present invention is to preserve the playing comfort and pleasure procured by acoustic drum kits, while providing the same advantages as a virtual drum kit (reduced bulk, low equipment needs, interactivity).

This is made possible in the example described hereinbelow.

It should firstly be specified that the example described herein relates to drum kits. It is understood that a person skilled in the art can apply the invention to other percussion instruments.

In the example described herein, the user U has a plurality of removable electronic devices 100 as shown in FIG. 1.

In this example, the user U attaches each of these devices 100 to drumsticks (FIG. 2), to a pedal for a bass drum beater (FIG. 3) or even on a hi-hat rod (FIG. 4).

More generally, the term "striking elements" EF will be used herein to denote the elements used by the musician to play the drums and strike the drum elements (cymbals, drums, toms, etc.)

Each of the devices 100 are attached to the striking elements EF by assembly means not described herein. These means can be a strap-type, male/female-type or click-and-lock-type fastening system, or any other system.

As mentioned hereinabove, the purpose of the present invention is to preserve the playing comfort and pleasure procured by acoustic drum kits.

For this purpose, the user U must, in the example described herein, define striking areas ZF during an initialisation phase P1.

Characteristically, in this phase P1, a so-called definition step S1 is carried out, whereby the user U defines these areas ZF on one or more tangible supports.

This definition of the striking areas ZF allows the invention to be differentiated from conventional virtual drum kit solutions for which there is, strictly speaking, no striking area since until now, the user had to play by striking the air and imitating the movements of a drummer.

In this example, these areas ZF should be defined.

The user U firstly defines the centre C_ZF of the striking area ZF (FIG. 5).

He/she must then define the periphery P_ZF of this striking area ZF (FIG. 6).

This definition S1 is carried out using defining software means 40 integrated into the device 100.

The software that manages this definition S1 of the areas ZF thus asks the user U to point the drumstick EF to which the device 100 is attached on any support (in this case a drum) in order to define the centre of the striking area ZF (FIG. 5).

The device 100 that comprises a gyroscope 20 thus provides the software with the coordinates x, y and z associated with the centre C_ZF of the striking area ZF designated by the user.

It should be noted that, in this example, the support chosen by the user U is a drum kit element (in this case a drum). Alternatively, within the scope of the present invention, the user could choose a table as a support. It is understood herein that any type of fixed physical support having a sufficient mechanical strength to provide a rebound and/or contact bounce of the striking element EF can be used as a support within the scope of the present invention, which allows the drums to be played anywhere.

The software then asks the user U to define the periphery P_ZF of this area ZF, still using this instrumentalised drumstick EF, which provides the coordinates x, y and z associated with the periphery P_ZF of the area ZF (FIG. 6).

The software thus records the spatial coordinates along the x, y and z axis of a first striking area defined by the centre C_ZF thereof and the periphery P_ZF thereof.

The user U can define a plurality of striking areas ZF in the same manner.

During this phase P1, the user U is then asked to associate each striking area ZF with a drum kit element. This is carried out during an allocation step S2 using allocating software means 50.

In this example, allocation thus takes place, whereby the user U can allocate, in a database DB, each striking area ZF previously defined with a drum kit element, for example the bass drum, the floor tom, the snare drum, the hi-hat or the cymbals (crash, ride, etc.).

A sound has already been associated with each drum kit element in this database DB.

The database DB thus built allows a sound associated with a drum kit element to be allocated to a striking area ZF virtually defined by the user U on any support such as, for example, a drum kit element, a table or a wall.

The customisation of these areas ZF in addition to the allocation of a drum kit element to each area ZF allows the user U to configure his/her drum kit as desired.

Once the database DB has been built, the user U is ready to play the drums (FIG. 1).

Then, during a playing phase P2, the user U must simply strike the one or more striking areas ZF previously defined using his/her striking elements EF.

The electronic device 100 thus comprises a plurality of sensors, including in particular an accelerometer 10 and a gyroscope 20 coupled with a magnetometer 30.

The device 100 further comprises a piezoelectric sensor (not shown herein). Such a sensor is capable of providing information indicating that the striking element EF has struck another element (in this case the support for example).

In this example, and as shown in FIGS. 7 and 8, the gyroscope 20 is capable of providing, during a step S4, information on the spatial coordinates x, y and z of the striking element EF upon the impact of the striking element EF with the support. The accelerometer 10 provides information on the velocity v of the striking element EF during the strike.

The module of sensors 10 and 20 will thus generate a stroke signal s1 comprising stroke information, in particular containing the spatial coordinates x, y and z of the striking element EF upon the impact of the striking element EF with the support, in addition to the velocity v of the striking element EF during the stroke.

This signal s1 is then processed during a step S5 by computer processing means 60 (for example a processor).

More particularly, these processing means 60 process the signal s1 so as to detect S5_1 the area ZF struck by the drumstick EF by analysing the spatial coordinates x, y and z in comparison with the database DB.

If a match exists between the x, y and z coordinates provided by the sensor 20 and the information contained in the database DB, the processing means 60 are capable of detecting that a striking area ZF defined by the user U during the phase P1 has been struck.

Once the area ZF struck has been detected, the processing means 60 query, during a step S5_2, the same database to determine the drum kit element associated with the area ZF struck.

In the example described herein, the device 100 further comprises generation means 70 designed to generate, during a step S6, a sound signal s2 comprising information on the sound virtually generated by the stroke of the striking element EF in the area ZF.

It should be noted here that the electronics embedded in the system allow this signal s2 to be generated with a latency of close to 0 ms, i.e. almost real-time signal generation.

This generation S6 of the sound signal s2 is thus a function of the area ZF struck and of the velocity v. This velocity v is more specifically translated by the means 70 in order to determine the intensity of the sound associated with the stroke.

The sound signal s2 ideally comprises information that can be understood and exploited by the communication terminal 110 shown in FIGS. 1 and 8.

In the example described herein, the sound signal s2, possibly in addition to the stroke signal s1, are transmitted respectively during transmission steps S8 and S7 to the terminal 110, preferably by wireless communication means (not shown herein), for example using a wireless communication protocol of the type Bluetooth® or NFC, etc.

The communication terminal 110 thus has software means specially designed to process and analyse the signals received in order to allow for the audible reproduction S10 of the sound virtually generated by the stroke of the element EF in the area ZF struck.

Similarly, in this example, software means are provided, designed to allow for the visual display S9 of the movements of the striking elements EF made by the user U, which in particular allows the user U to view, on the screen of the terminal 110, the tempo or to view the playing precision.

In the example described herein, the terminal 110 comprises software means (not shown herein) designed to analyse the drummer's playing in real time; such an analysis of the playing for example allows functionalities for learning to play the drums to be implemented (partitions, lessons, etc.).

Musicians using the system 200 can thus practice and see whether their beat corresponds to the partition that they are playing in real time (visual and audio alerts linked to the tempo and elements that must be struck from the software).

It should be noted here that, within the scope of the present invention, synchronisation means (not shown herein) are also provided, designed to synchronise the internal clocks of each electronic device such that the signals generated by each device are in sync with one another. For this purpose, a synchronisation of the devices of the system is carried out before each playing phase.

The present invention thus proposes a true computer-based system 200 for emulating the sound of a percussion instrument with minimal equipment.

Such a system 200 is in particular composed of an electronic device 100, such as that described hereinabove, a communication terminal 110 comprising dedicated software applications, and a database DB of specific data. It should be noted here that the database DB can be stored on a remote server or directly on the communication terminal 110.

The electronic device 100 is present in the form of a device that is easy to use, has small overall dimensions, is removable and is to be attached, for example, to drumsticks or to a drum pedal.

Such a device 100 coupled with dedicated software allows for the real-time sensing of the areas struck (physical impact of the drumsticks to which the sensors have been attached or impact of the drum pedals on solid supports), the power of the stroke, the velocity of the stroke, and the exact location of the impact in a multi-dimensional environment.

The various data collected by the device 100 are subjected to computer processing in real time and are then sent to the communication terminal 110, which can, in particular by way of a dedicated software application, be used in particular to:

emulate the sound of a drum kit;
record the beat of a drummer for future musical use;
monitor the drummer's tempo;
assess the precision of the strokes;
monitor the drummer's progress.

It should be noted that the system proposed herein within the scope of the present invention helps drummers learn to play the drums and simplifies the recording and sharing of the drummer's beats.

Another advantage of the present invention is that it allows the real playing style of a drummer to be reproduced, thanks to the playing comfort and pleasure procured by the rebound resulting from the stroke on the support and not in the air, as is currently proposed with "air drum kits".

When playing the drums, the drummer can thus record his/her beat in a precise, fast and easy way, in accordance with his/her customised configuration (position and locations of his/her toms, cymbals) and thus of his/her points of impact.

There is no need to position microphones or stroke sensors in the striking areas.

It should be noted that this detailed description concerns one specific example embodiment of this invention, however in no way does this description limit the purpose of the invention in any way: on the contrary, it aims to remove all possible imprecisions or all incorrect interpretations of the claims provided hereafter.

It should also be noted that the reference signs placed in brackets in the claims provided hereafter are in no way limiting; the sole purpose of these signs is to improve the intelligibility and understanding of the claims provided hereafter, in addition to the desired scope of protection.

The invention claimed is:

1. A method for emulating at least one sound of a drum-type percussion instrument using at least one striking element instrumentalised by an electronic device attached in a removable manner to said at least one striking element and comprising at least one sensor designed to provide at least one piece of information, referred to as stroke information, on a stroke of a user with said at least one striking element, the at least one sensor having at least one gyroscope-type sensor providing information on spatial coordinates of the striking element at the time of the impact of the striking element in a striking area, said method implemented by computer-based means comprising:

a) an initialisation phase comprising:

defining, on at least one tangible support, at least one striking area, the at least one striking area being defined by the user using said gyroscope-type sensor providing information on spatial coordinates of the striking element at the time of the impact of the striking element in the at least one striking area, the spatial coordinates being associated with a center of the striking area and with a periphery thereof;

allocating, in a database, said at least one striking area previously defined with a drum kit element associated with a predetermined sound;

b) a playing phase comprising:

after a stroke by the user with said striking element in said at least one striking area, acquiring at least one stroke signal generated by said at least one sensor and comprising said at least one piece of stroke information, said gyroscope-type sensor providing information on spatial coordinates of the striking element at the time of the stroke;

processing said at least one stroke signal, taking into consideration the spatial coordinates of the striking element, in such a way as to spatially locate said stroke in order to detect said area struck and to determine, by comparing with said database, the drum element corresponding to said area struck;

generating a sound signal comprising information on a sound virtually generated by said stroke of the striking element in said area struck.

2. The method according to claim 1, wherein said at least one sensor comprises an accelerometer-type sensor, wherein, during the acquiring, said sensor provides information on the velocity of said striking element, and wherein, during the generating, said velocity of said striking element is taken into consideration to calculate the intensity of said sound virtually generated by said stroke of the element in said area.

3. The method according to claim 1, further comprising transmitting said sound signal to a communication terminal by wireless communication means in order to audibly reproduce the sound virtually generated by said stroke of the element in said area on said terminal.

4. The method according to claim 1, further comprising transmitting said at least one stroke signal to said communication terminal by wireless communication means in order to visually display the movements of said at least one striking element on said terminal.

5. A non-transitory computer-readable recording medium on which a computer program is recorded, said computer program comprising instructions for executing the steps of the method according to claim 1.

6. A removable electronic device for emulating at least one sound of a drum-type percussion instrument, said device being intended to instrumentalise a striking element, comprising:

at least one sensor configured to generate a stroke signal comprising at lease one piece of stroke information on a stroke of a user with said at least one striking element in said at least one striking area, said at least one sensor corresponding to at least one gyroscope-type sensor providing information on spatial coordinates of the striking element at the time of the impact of the striking element in the striking area;

a definer designed to define at least one striking area on at least one tangible support, said definer and said gyroscope-type sensor being configured to cooperate so that a user defines said at least one striking area with said gyroscope-type sensor providing information on spatial coordinates of the striking element at the time of said stroke, said spatial coordinates being associated with a center of the striking area and with a periphery thereof;

an allocator designed to allocate a drum element associated with a predetermined sound to said at least one striking area, in a database;

computer processing means implementing a processing algorithm configured to process said stroke signal, taking into consideration said spatial coordinates of the striking element, to spatially locate said stroke in order to detect said area struck and to determine, by comparing with said database, the drum element corresponding to said area struck;

generating means configured to generate a sound signal comprising information on a sound virtually generated by said stroke of the striking element in said area struck.

7. A computer-based system for emulating at least one sound of a drum-type percussion instrument, said system comprising:

a removable electronic device according to claim 6, and a communication terminal configured to communicate with said electronic device by wireless communication means, said communication terminal comprising software means designed to receive and process said sound signal generated by said device in order to audibly reproduce the sound virtually generated by the stroke of the striking element in the area struck.

* * * * *